United States Patent [19]

Brell

[11] Patent Number: 4,880,024

[45] Date of Patent: Nov. 14, 1989

[54] SELF-SUPPORTING TENT

[76] Inventor: Siegfried Brell, Furstenbergstrasse 88-90, 7750 Konstanz, Fed. Rep. of Germany

[21] Appl. No.: 36,591

[22] Filed: Apr. 10, 1987

[30] Foreign Application Priority Data

Apr. 15, 1986 [DE] Fed. Rep. of Germany ..... 3612623

[51] Int. Cl.[4] ..... E04H 15/34

[52] U.S. Cl. ..... 135/101; 135/DIG. 5

[58] Field of Search ..... 135/97, 101, 105, DIG. 5

[56] References Cited

U.S. PATENT DOCUMENTS

| | | | |
|---|---|---|---|
| 1,349,980 | 8/1920 | Richards | 135/101 X |
| 1,491,849 | 4/1924 | Dickey | 135/DIG. 5 |
| 1,808,693 | 6/1931 | Terzoli | 135/101 |
| 2,015,321 | 9/1935 | Shelton | 135/DIG. 5 |
| 3,810,481 | 5/1974 | Nohmura | 135/101 |
| 3,925,942 | 12/1975 | Hemmelsbach | 135/97 |
| 4,008,730 | 2/1977 | Keklak et al. | 135/97 |
| 4,036,244 | 7/1977 | Huddle | 135/97 X |

FOREIGN PATENT DOCUMENTS

| | | | |
|---|---|---|---|
| 653800 | 11/1928 | France | 135/97 |

*Primary Examiner*—Henry E. Reduazo
*Assistant Examiner*—Lan Mai
*Attorney, Agent, or Firm*—Bachman & LaPointe

[57] ABSTRACT

A self-supporting tent structure for protecting small private aircraft and the like comprises a plurality of vertical side posts each defining a corner of the tent to which a roof membrane is secured. A lifting apparatus is connected to the roof membrane for selectively moving the roof member between an untensioned position and a tensioned position. A truss member is provided for supporting steadying struts against the side posts for providing stability to the self-supporting tent.

10 Claims, 5 Drawing Sheets

SELF-SUPPORTING TENT

BACKGROUND OF THE INVENTION

The present invention relates to a self-supporting tent, particularly for roofing in or protecting smaller private aircraft, with a roof membrane and optionally side walls e.g. made from a textile material, which cover or surround a framework formed from a roof frame and side posts.

Nowadays aircraft are housed in hangars, which are generally large buildings fixed to the ground and in which several aircraft can be placed. However, such constructions require official authorization and are generally very expensive. As an airfield does not generally have sufficient hangar spaces for aircraft, it is necessary for them to be left outside. They are then exposed to the weather, so that not only the aircraft itself, but also the expensive electronics can become easily damaged. Quite apart from this, damage to parked aircraft in hangars occur when new aircraft enter the same.

For other vehicles and also in completely different fields of use, such as e.g. for large scale celebrations, tent-like structures are known, whose side posts are connected to the ground via bracing cables and pegs. These bracing cables form trip wires and in the past have led to serious human injuries. In the known tent-like structures, the roof membrane is placed on a roof frame. For example, when it rains, trough formation occurs in the roof membrane, which not only unfavourably influences the entire statics of the tent, but can also lead to the membrane tearing.

In larger tents, such as e.g. circus tents, masts are used for tensioning the roof membrane and on said mast can be suspended and raised the membrane. However, as a result of these centre posts the interior of the tent can only be used to a limited extent.

SUMMARY OF THE INVENTION

The problem of the present invention is to develop a tent of the aforementioned type, which requires no lateral bracing cables, but still has very considerable stability. In addition, the entire interior of the tent is to be usable without restriction.

According to the invention this problem is solved in that the side posts are connected to trusses and that the roof frame has a tensioning device for tensioning the roof membrane.

The trusses lead to a high lateral stability, so that the tent does not collapse even in gales. It is only necessary to connect the side posts to the ground by stays or truss wires. The tensioning device improves the lateral stability and prevents trough formation in the roof membrane.

Preferably a frontal truss comprises an upper and a lower supporting rod, which are interconnected by means of struts. Both supporting rods are preferably connected in articulated manner to the side posts. In this case, the articulated connection provides the possibility of horizontally moving the truss.

Only an upper supporting rod is provided for the lateral trusses and is supported against the side posts by means of steadying struts. The roof frame comprises individual structural rods, which have a common intersection or junction point and are connected in articulated manner with the side posts.

According to the invention the connection of all parts of the inner framework, i.e. the side posts, trusses and structural rods of the roof frame takes place in such a way that it can be easily removed again. Preferably the connection of each individual component takes place by means of a pivot pin which, in the use position, traverses two sleeves fixed to one part and between which engages a further sleeve fixed to the other part.

In the manufacture of the tent, it is particularly advantageous if the individual parts are as similar as possible. This applies more particularly for the upper and optionally also the lower supporting rods of the trusses and the structural rods, which have an identical length. For parking aircraft the tent is constructed as a pentagon, the frontal truss having a maximum span width, which somewhat exceeds that of the aircraft to be parked. In the case of an identical length of the other trusses and structural rods a pentagon is achieved and a zone is formed in which the aircraft nose can be received.

With respect to the tensioning device, it is provided that a threaded sleeve projects into the junction point and said sleeve is traversed by a threaded rod or spindle, which can e.g. be moved by means of a moment crank in the threaded sleeve. A head sleeve is loosely mounted on the threaded rod and from it project cover plates, to which the roof membrane is fixed. If the threaded rod is moved in direction X, it takes the roof membrane with it and consequently tensions it. This tensioning is also improved if wire ropes are drawn into the roof membrane, which are on the one hand connected to the side posts and on the other to hooks and cover plates. It has proved to be particularly effective and easily detachable if so-called terminals are as hooks, of the type known from sailing or yachting. These terminals are inserted with a hammer head in an elongated hole and fixed by turning by approximately 90°. In the present case, the terminal hammer head passes through a loop of the wire cable and an elongated hole in the roof strip or cover plate.

The complete inventive tent is therefore manufacturable very simply with relatively few components and therefore inexpensively. Its setting up and removal also take place simply and rapidly, whilst it has extremely favourable stability.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
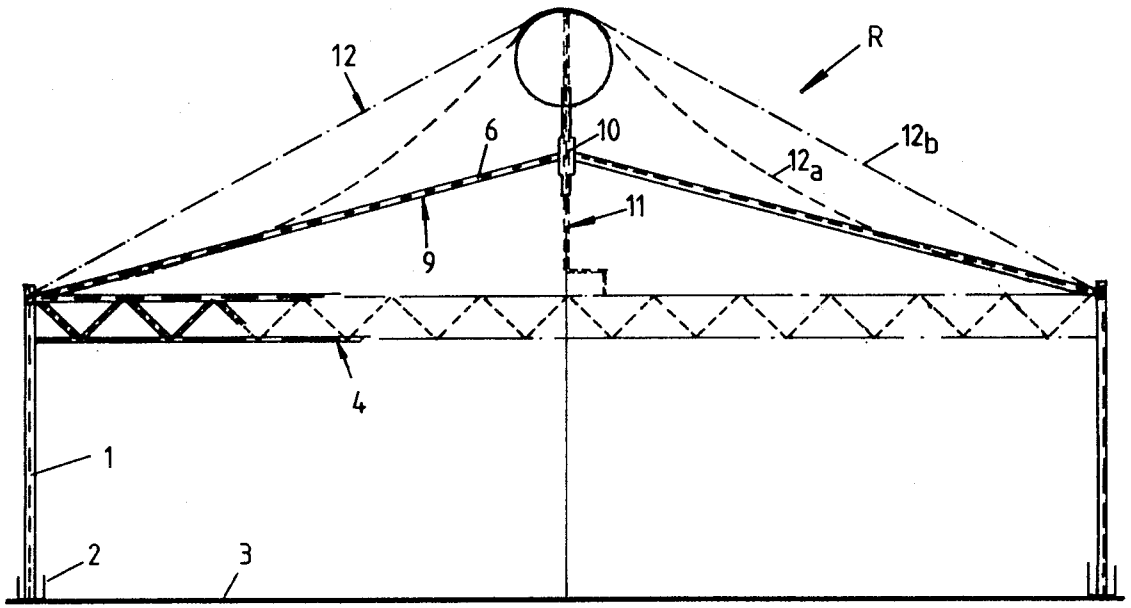
FIG. 1, a front view of an inventive self-supporting tent.
Figure 2:
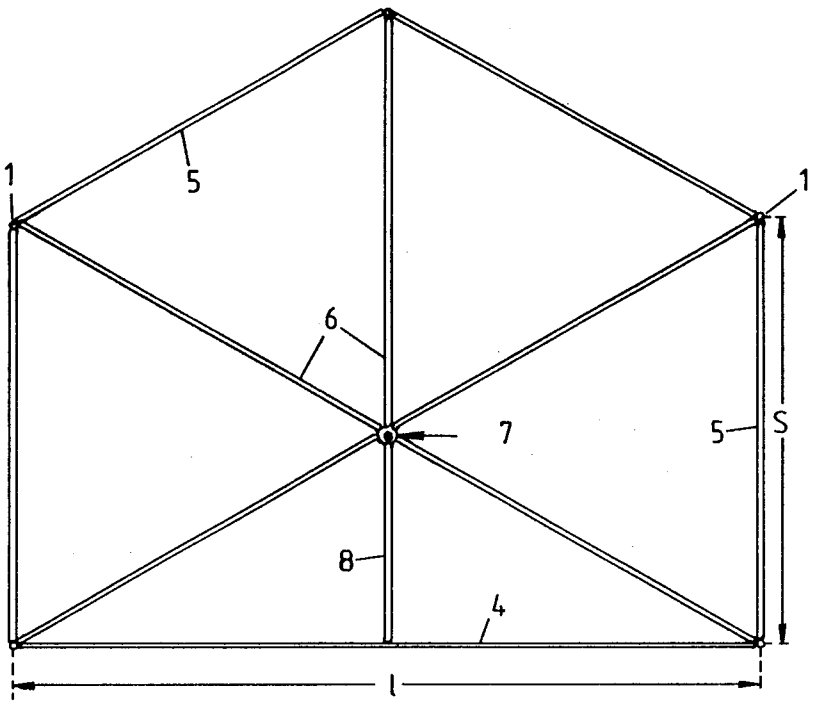
FIG. 2, a plan view on a roof frame of the tent according to FIG. 1.

In an inventive self-supporting tent R, side posts 1 are arranged in the form of a pentagon according to FIGS. 1 and 2. In the use position the side posts are fixed by means of stays 2 in a corresponding substrate 3.

Figure 4:
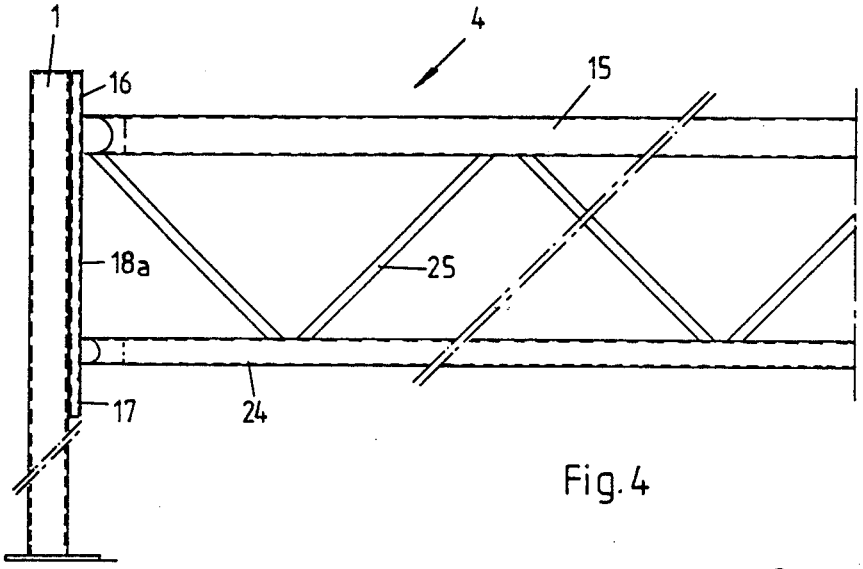
FIG. 4, a larger scale front view of truss supports of the front of the tent.

The two front side posts 1 are connected by a truss 4, partly shown in FIG. 4 and which has the greatest span width. The other side posts 1 are connected to one another and to the front side posts 1 by means of trusses 5 having the same length s. Structural rods also have the same length S and are articulated at one side to side posts 1 and converge in roof-like manner to a common junction point. These structural rods 6 together with a rod 8 running approximately vertically from junction point 7 to truss 4 form the roof frame 9.

Figure 6:
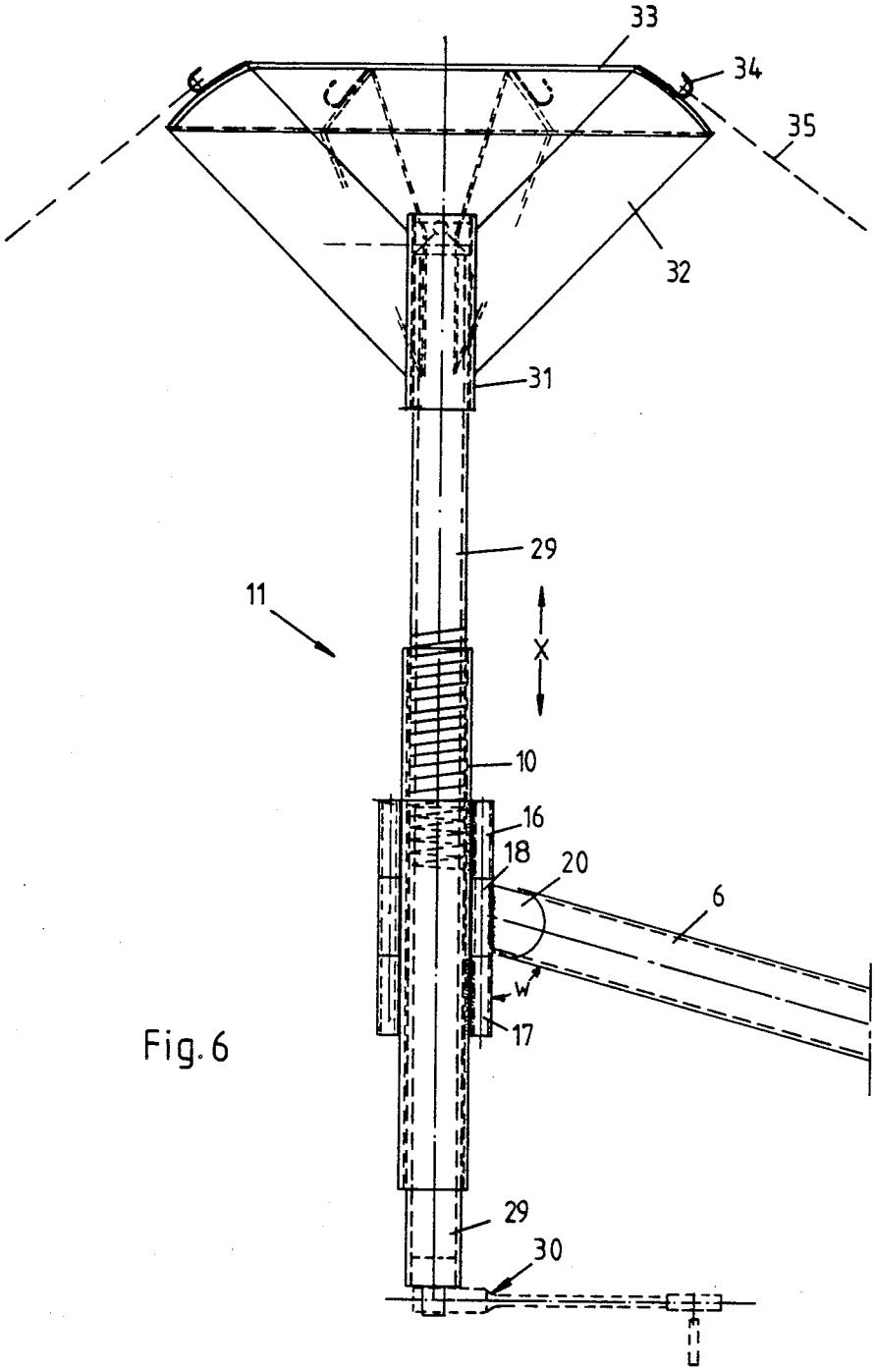
FIG. 6, a larger scale front view of a tensioning device for a tent roof membrane.

At junction point 7 there is a substantially vertical threaded sleeve 10, which is traversed by a tensioning device 11. The construction of the tensioning device is described in greater detail relative to FIG. 6. By means of said tensioning device the roof membrane 12, which is e.g. made from a textile material, is transferred from an untensioned position 12*a*, shown in broken line manner, into a tensioned position 12*b*, shown in dot-dash line manner. To faciliate visibility, the tent side walls are formed by mats, e.g. of textile material.

Figure 3:
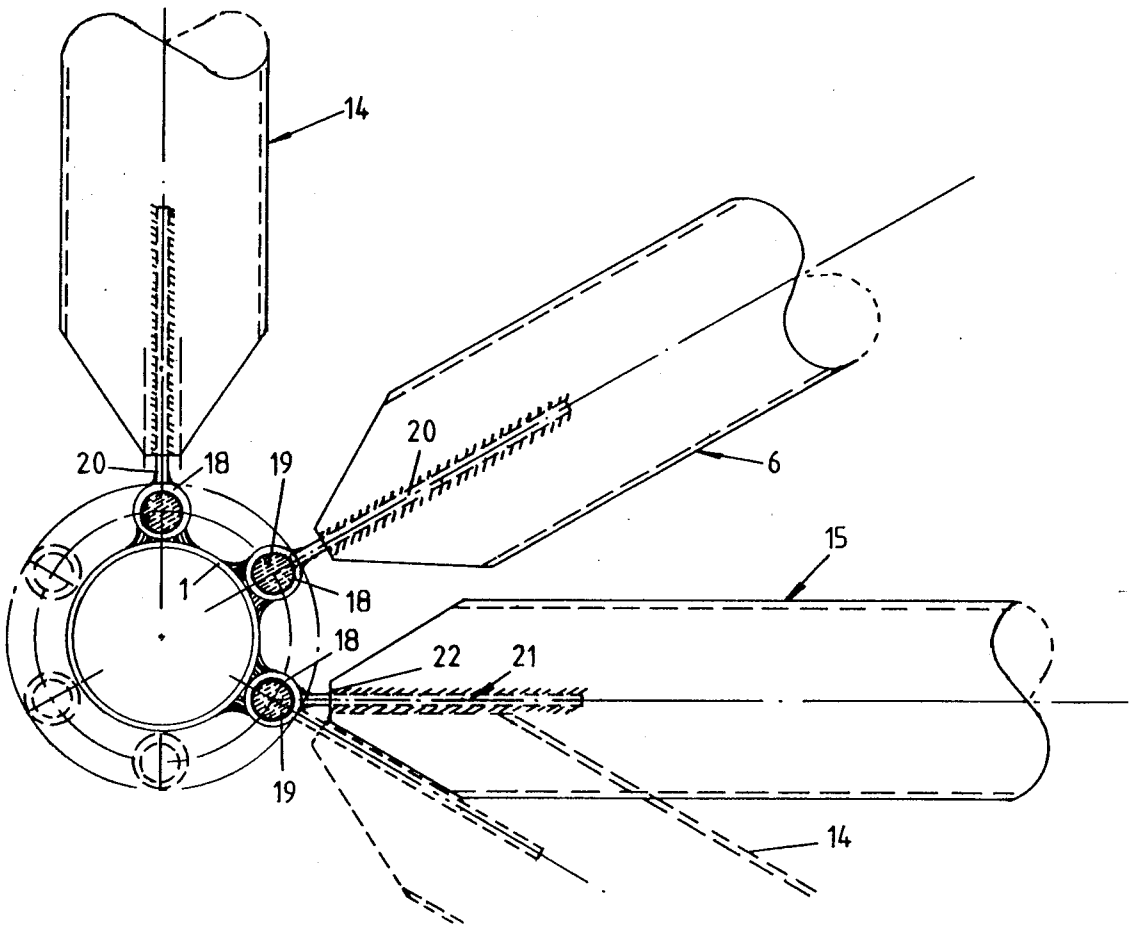
FIG. 3, a larger scale plan view of an intersection of the roof frame and side posts.
Figure 5:
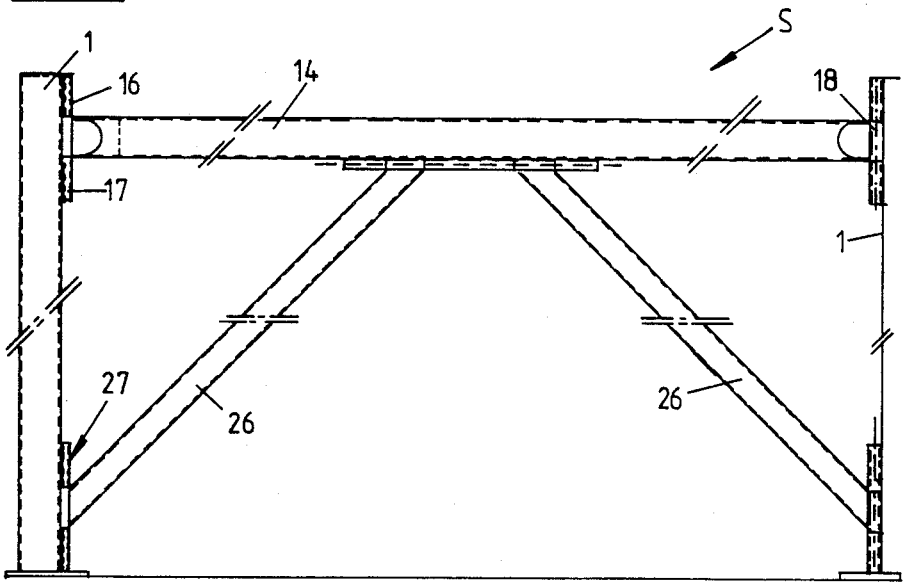
FIG. 5, a larger scale front view of truss supports of the sides of the tent.

FIG. 3 shows the articulated connection between an upper supporting rod 14 of truss 5, an upper supporting rod 15 of truss 4 and a structural rod 6 with a side post 1. For this purpose, upper and lower hinge sleeves 16, 17 (FIGS. 4 and 5) are welded to side posts 1. A sleeve 18 is inserted between the two hinge sleeves 16, 17 and all three sleeves 16, 17, 18 are connected by means of a bolt 19, which gives a hinge joint. A tongue 20 is welded to sleeve 18 and engages in a slot 21 in the front face 22 of structural rod 6 or the upper and lower supporting rods 14, 15 and is fixed there.

FIG. 3 shows in broken line form the connection of two upper supporting rods 14 of trusses 5. FIG. 3 also shows in broken line form the connection of structural rod 6 and rod 8 in junction point 7. In this case thread sleeve 10 is placed in the centre in place of side post 1.

According to FIG. 4, truss 4 comprises the upper supporting rod 15 and a lower supporting rod 24, which are interconnected by struts 25. Upper supporting rod 15 and lower supporting rod 24 have a connection with a common sleeve 18*a*, which engages between the upper hinge sleeve 16 and the lower hinge sleeve 17 of side post 1.

Truss 5 only comprises the upper connecting rod 14, which is fixed between two side posts 1. However, roughly in the centre of the upper supporting rod 14, steadying struts 26 extend up to the foot region of side post 1, to which they are connected by a hinge connection 27. Hinge connection 27 also comprises bolts passing through corresponding sleeves. The steadying struts 26 are connected to the upper supporting rod 14 in a similar manner.

Tensioning device 11 for tensioning the roof membrane 12 comprises the threaded sleeve 10 with the upper and lower hinge sleeves 16, 17 fixed thereto, between which sleeve 18 with tongue 20 engage for connecting the structural rod 6. However, in this case structural rods 6 form an angle w with e.g. the lower hinge sleeve 17, which is smaller than 90° C.

Threaded sleeve 10 is traversed by a threaded rod 29, which can be turned by means of a moment crank 30, so that threaded rod 29 is moved in direction x.

At the other end of the moment crank a head sleeve 31 is located on threaded rod 29 and the latter freely rotates therein. Onto said head sleeve 31 are shaped several freely projecting cover plates 32, which are interconnected by means of roof strips 33. There are in general five cover plates 32, hooks 34 being fixed to each cover plate 32 or the roof strip 33 and in said hooks can be hung a wire rope 35 passing through the roof membrane. The other end of the wire rope 35 is fixed to a side post 1. In place of hooks 34, according to a preferred embodiment a terminal is provided, which passes through a ring of the wire rope 35 and is inserted in an elongated hole in roof strip 33 running in the direction of roof 35 and is then turned by approximately 90°.

What is claimed is:

1. A self-supporting tent having a roof membrane comprising at least a first, a second and a third substantially vertical side post each defining a corner of the tent and to which the roof membrane is secured; a truss member extending between the upper end of each side post, at least one truss member comprises an upper and a lower supporting rod interconnected by means of struts and the other truss members comprise an upper supporting rod supported by steadying struts against the side posts; lifting means connected to said roof membrane for selectively moving said roof membrane between an untensioned position and a tensioned position; a structural member extending between the upper end of each side post and the lifting means and defining therewith a first junction point; and at least one rod extending in a substantially vertical direction from said one truss member to said first junction point.

2. A tent according to claim 1 wherein the structural members are connected in articulated manner to the side posts.

3. A tent according to claim 2 wherein the connection of truss members and side posts, the structural members and side posts, the structural members and the junction point and the reinforcing rod and junction point take place by means of a hinge connection.

4. A tent according to claim 3 wherein the hinge connection comprises in each case two sleeves fixed to one of the side posts and the junction point and in which engages a further sleeve connected to the one of the truss members and the structural members and fixed in rotary manner by means of a bolt.

5. A tent according to claim 4 wherein the sleeve engages with a tongue in a slot in the end face of one of the structural rods and truss members.

6. A tent according to claim 1 wherein the structural members have substantially the same length.

7. A tent according to claim 1 wherein the lifting means comprises a threaded sleeve, which is traversed by a threaded rod, which is moved by means of a moment crank in the vertical direction.

8. A tent according to claim 7 wherein a head sleeve is mounted in rotary manner on the threaded rod and wherein cover plates project from said head sleeve on which is fixed the roof membrane.

9. A tent according to claim 8 wherein wire ropes are drawn through the roof membrane and are fixed on the one hand to the side posts and on the other with hooks on the cover plates.

10. A tent according to claim 9 wherein terminals are used as hooks.

* * * * *